US010472152B2

(12) United States Patent
Geier et al.

(10) Patent No.: US 10,472,152 B2
(45) Date of Patent: Nov. 12, 2019

(54) CONTAINER OF A FLUID SUBSTANCE AND A TRANSPORT SYSTEM THEREFOR

(71) Applicant: Coster Tecnologie Speciali S.p.A., Calceranica al Lago (TN) (IT)

(72) Inventors: Adalberto Geier, Calceranica al Lago (IT); Alfeo Tecchiolli, Meano (IT)

(73) Assignee: Coster Tecnologie Speciali S.P.A., Calceranica al Lago (TN) (IT)

( * ) Notice: Subject to any disclaimer, the term of this patent is extended or adjusted under 35 U.S.C. 154(b) by 0 days.

(21) Appl. No.: 16/180,872

(22) Filed: Nov. 5, 2018

(65) Prior Publication Data

US 2019/0135511 A1 May 9, 2019

(30) Foreign Application Priority Data

Nov. 9, 2017 (IT) ..... 102017000128114

(51) Int. Cl.

| | |
|---|---|
| ***B65D 71/50*** | (2006.01) |
| ***B65D 67/02*** | (2006.01) |
| ***B65D 21/02*** | (2006.01) |
| ***B65D 83/38*** | (2006.01) |
| *B65D 83/62* | (2006.01) |

(52) U.S. Cl.

CPC ..... *B65D 71/502* (2013.01); *B65D 21/0224* (2013.01); *B65D 21/0231* (2013.01); *B65D 67/02* (2013.01); *B65D 83/38* (2013.01); *B65D 83/62* (2013.01)

(58) Field of Classification Search

USPC ..... 206/503; 222/630, 631, 632, 635

See application file for complete search history.

(56) References Cited

U.S. PATENT DOCUMENTS

| | | | | |
|---|---|---|---|---|
| 6,578,724 | B1 | 6/2003 | Owens | |
| 7,819,286 | B2 * | 10/2010 | Antheil | B65D 21/0231 220/495.01 |
| 2005/0205453 | A1 * | 9/2005 | Gindi | A47F 3/14 206/503 |
| 2005/0211736 | A1 * | 9/2005 | Finlay | B67D 1/0456 222/509 |

(Continued)

FOREIGN PATENT DOCUMENTS

| | | | |
|---|---|---|---|
| EP | 2195257 | A1 | 6/2010 |
| GB | 2320482 | A | 6/1998 |

(Continued)

*Primary Examiner* — Jacob K Ackun

(74) *Attorney, Agent, or Firm* — King & Schickli, PLLC

(57) ABSTRACT

A fluid container in the form of a can having a neck defining an opening, and fastened in a water-tight manner to the neck a valve element with a valve cup supporting a hollow stem movable against an elastic element between a first stable closing position and a second unstable position for delivering fluid through a cavity in the stem, the cavity communicating with the interior of the can in a dispensing position, the can being fixed to a support base of the container, the base comprising a support surface with a recess defined by a first centering surface to center the container on a valve cup of an identical container, on top of which the container may be placed, a second support surface for supporting the container on the valve cup, and a third recessed surface to house the stem of an aerosol valve of the further container.

7 Claims, 4 Drawing Sheets

(56) References Cited

U.S. PATENT DOCUMENTS

| | | | | |
|---|---|---|---|---|
| 2005/0230435 | A1* | 10/2005 | Delbarre | B65D 11/08 222/400.7 |
| 2007/0108232 | A1* | 5/2007 | Loebach | B65D 1/0223 222/143 |
| 2011/0132790 | A1* | 6/2011 | Dorn | B65D 21/0231 206/509 |
| 2013/0219831 | A1* | 8/2013 | Trude | B65D 1/0276 53/453 |
| 2018/0208361 | A1* | 7/2018 | Klein | B65D 21/0224 |

FOREIGN PATENT DOCUMENTS

| | | | |
|---|---|---|---|
| JP | H11301757 | A | 11/1999 |
| WO | WO2017021038 | A1 | 2/2017 |

* cited by examiner

CONTAINER OF A FLUID SUBSTANCE AND A TRANSPORT SYSTEM THEREFOR

FIELD OF THE INVENTION

The present invention relates to a container of a fluid substance and a transport system therefor.

In particular, the invention refers to a pressurised container for the storage and dispensing, preferably in the form of an aerosol, of a fluid substance contained within the container.

BACKGROUND ART

Pressurised containers according to prior art (generally referred to as aerosol cans) are known, which may contain a fluid dispensable in the form of fine spray or foam.

The fluid to be dispensed can be a deodorant, a paint, a shaving foam, a cream, a gel, a sun protection product, etc.

Historically, aerosol cans were made of metal. However, during recent years, the market has begun to demand at least partially plastic bottles.

One example of such plastic containers is described in patent application WO2017/021038-A1, filed in the name of the holder of this patent.

The container described in the aforesaid application is particularly effective from a functional point of view, however the costs of manufacturing the plastic bottles prove to be somewhat high since the container must be sufficiently thick to withstand the operating pressure.

Transportation of the container is also somewhat onerous, since the canisters described in the aforesaid document are marketed already pressurised, with the valve mounted on and soldered to a neck of the said container.

Currently, the pre-loaded canisters are transported using a valve stem protection element which is generally fixed to the valve cup or to the metal canister.

The filling with the fluid substance intended to be dispensed from the canister only takes place later on, by means of a filler, which proceeds by injecting the fluid substance directly thereinto, via the stem, in the opposite direction to the dispensing flow.

SUMMARY OF THE INVENTION

The object of the present invention is to provide a container of fluid substances which is less costly and more reliable than the conventional plastic containers.

Advantageously, the container is more stable in when placed in a standing position than conventional plastic containers.

A further object of the invention is to provide a container suitable for a transport system, which is more cost-effective and minimises damage to the material (in particular the stem) during transport, as well as the volume to transport.

This and other objects are achieved by means of a container and by a transport system produced according to the technical teachings of the claims annexed hereto.

BRIEF DESCRIPTION OF THE FIGURES

Further characteristics and advantages of the invention will become clearer in the description of a preferred but not exclusive embodiment of the device, illustrated—by way of a non-limiting example—in the drawings annexed hereto, in which.

DETAILED DESCRIPTION OF THE INVENTION

With reference to the figures stated, reference number 1 or 1A is used to denote, as a whole, a container of fluid substances.

The container 1 is configured to contain a fluid substance, preferentially in a liquid form, which for example, can be a deodorant, a paint, a shaving foam, a cream, a gel, a sun protection product, etc.

Figure 1:
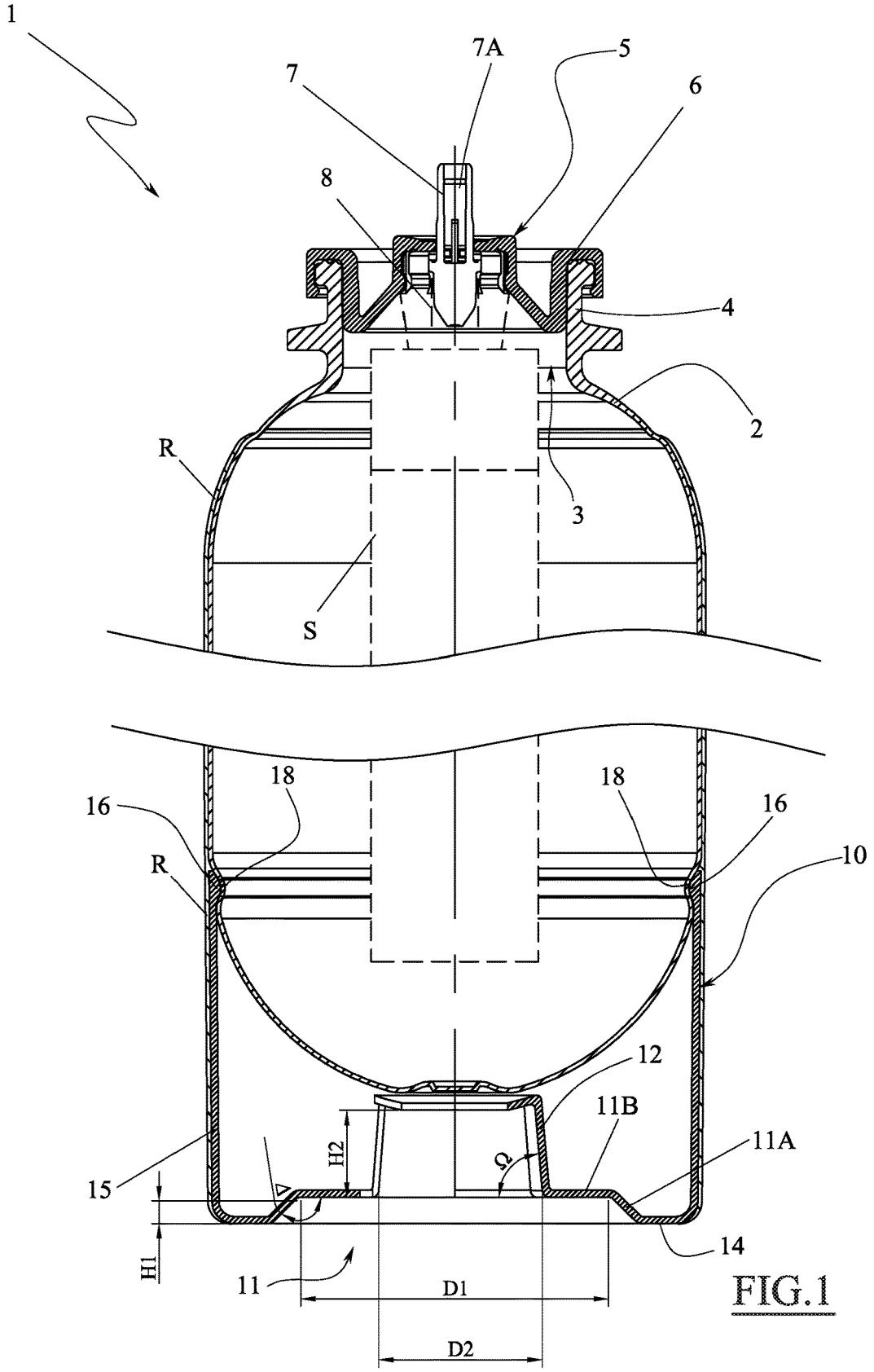
FIG. 1 is an axial section of a container according to the present invention.

As can be seen in FIG. 1, the container 1 comprises a can 2 made by plastic-blowing.

Preferably the plastic material used for the can 2 is PET. Alternatively the can 2 may be made of PEN, a PET/PEN blend, PETG, etc.

The can 2 is provided with a neck 4 which defines an opening 3 giving access to the internal compartment of the container.

A valve element 5 is fixed to the neck 4 and comprises a valve cup 6 supporting a movable hollow stem 7 against an elastic element (for example a spring, shown only schematically here, but of the conventional type).

The stem 7 is movable between a first stable closing position and a second unstable position for dispensing the fluid substance through a cavity 7A in the stem 7.

In fact, when the stem is pressed downwards in FIG. 1, this results in the dispensing of a product (contained in the container) through the cavity 7A. Indeed, when the stem is in the dispensing position, the said cavity is in communication with the interior of the can 2.

Advantageously, in such a configuration, a suction tube associated with the valve 5 can be envisaged.

Alternatively, as shown in FIG. 1, the valve 5 may be in communication with the inside of a deformable bag S contained inside the can 2 and soldered (or otherwise fastened mechanically), in an air-tight manner, to the valve element 5 (or a portion thereof).

The bag S (shown with a dashed line in FIG. 1) may be of the conventional type, for example, made of laminated film sheets. The bag may be composed of a multilayer film, wherein the internal layer, if fastened by means of soldering, is preferably made of the same material as the valve element.

Continuing with the description of FIG. 1, it should be noted that the can 2 is fastened permanently to a base 10 to support the container 1.

The base 10 may be made by moulding plastic and forming a single piece, for example, PP or PE, PET, PS, etc.

The base 10 comprises a resting surface 14 provided with a recess 11 defined by a first centering surface 11A configured to centre the container 1 on a valve cup 6 of a further container 1A (FIG. 2) which is identical to the first, on top of which the container 1 may be placed.

The recess 11 furthermore features a second surface 11B for the stable support of the container 1 on the valve cup 6 of the further container 1A.

Suitably joined to the second surface 11B, there is a third surface 12 which is recessed with respect to the second surface 11B and configured to house and protect the stem 7 of an aerosol valve on the further container 1A.

In fact, the presence of a base 10 like the one described, associated with the can 2, allows several containers to be stacked up, furthermore ensuring excellent protection of the stem 7, which is an extremely delicate part of the valve element 5.

Furthermore, the presence of a support surface 14, such as the one described above, which may have a circular crown configuration, makes the resting position of the container 1 more stable than that of other similar plastic aerosol cans made of one piece, with a petaloid or champagne base.

To improve the coupling of the base of the container 1 with the valve cup of the further underlying container, the first surface may have a truncated cone shape 1B. This also applies to the third surface 12, which may also have a truncated cone shape.

It must be said that the first surface 11A is configured so as to centre a container 1 on a further underlying container 1A. However, the centering occurs with a considerable tolerance, so as to allow an amount of clearance G ranging, for example, from 0.5 to 1.5 mm.

The clearance G, in any case, is sufficient to keep the stem 7 inside the compartment defined by the third surface 12, in all positions, so as to protect the said stem, preventing contact between the walls defining the surface 12 and the said stem 7.

Advantageously, the maximum diameter D1 of the second surface 11B is configured to house the valve cup.

For example, D1 may be between 34 mm and 36 mm, preferably 35.6 mm, so as to easily house a valve cup with a diameter which may be between 32.5 mm and 34 mm.

The height between the support surface 14 and the second surface H1 may vary according to stacking requirements, to ensure greater stability during transportation. For example, D1 may be between 2.5 mm and 3.5 mm.

The joint angle A between the first 11A and the second surface 11B may be between 30° and 60°, advantageously 45°. These angles allow very effective centring when stacking the containers 1.

In addition, the diameter D2 of the coupling between the second surface 11B and the third surface 12 may be configured so as to ensure correct support of the canister base on the valve cup or on the thermoformed sheet on the base of the pallet.

D2 may be between 19 and 21 mm. Indeed, this size allows a suitable housing to protect the stem, and part of a casing 70 of the valve cup, from which the stem 7 extends axially.

The angle Q formed between the second surface 11B and the third surface 12 may be between 88° and 82°.

These values guarantee the best possible protection for the stem 7, even in the presence of oscillations of the contained stacked on top of the underlying one.

The height H2 between the second surface 11B and the top of the compartment defined by the second surface may be between 7 mm and 10 mm.

This provides protection of the stem with appropriate clearance to prevent the stem coming into contact with the base of the canister stacked on top.

Once the can 2 has been pressurised and the valve cup 6 is temporarily fastened to the neck of the container, for example, by snap-coupling, the said components can be soldered together.

It has been found that laser soldering offers excellent coupling stability, for example, when both the container and the valve cup are made of plastic or when there are mutually contacting parts made of plastic.

Figure 3:
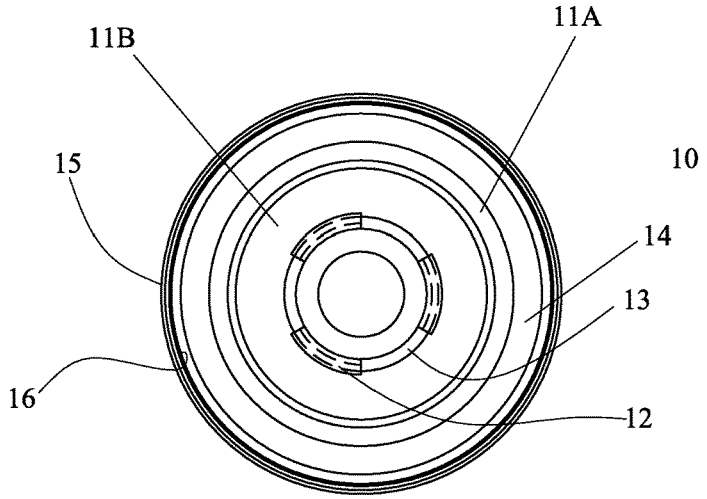
FIG. 3 is a top-down plan view of the base of the container in FIG. 1.

However, in order to obtain a good solder, it is necessary to rotate the container around its own axis, for example at a constant speed. To facilitate this processing stage, the third surface 12 may comprise windows 13 (preferably three, as shown in FIG. 3), configured to cooperate with a container rotation tool, precisely during soldering of the valve cup to the can.

In other words, windows 13, preferably formed in correspondence with the third surface 12, allow a torsional coupling between the container and a tool suitable to rotate around the axis thereof, during at least one operation to solder together the valve cup 6 and the can 2.

Returning to the description of the base 10 (FIG. 1), it should be noted that, a cylindrical skirt 15 (which may have the same diameter externally as the can 2) extends outwards from the supporting surface 14 thereof, the said skirt featuring, at one end thereof, a protruding edge 16 configured so as to cooperate, via a snap coupling, with a groove 18 made in the can 2 itself.

In this way, it is possible to fasten the base 10 to the can 2 stably and quickly, with a snap coupling.

The container 1 may also have a plastic film coating R, for example made with a heat-shrinkable or adhesive plastic film, which will make the coupling between the can 2 and the base 10 even more stable.

Advantageously, the whole of the lateral surface of the can 2 and the base 10 are covered by said film, which can feature, printed in a conventional manner, logos, decorations or other items, so as to improve the aesthetics of the container.

The presence of the covering, in fact, makes it impossible to distinguish the container, which is made up of two parts (can plus base), from a conventional aerosol can, all to improve aesthetics.

The presence of a base 10 coupled to the can 2 allows the latter to be made with a surface area of the base which is sufficient to withstand, very well, the pressure inside the said can 2 (which, during use, can reach 7-9 bars).

One very effective solution is to provide the base with an essentially hemispherical conformation or a ball cap. This makes it possible to produce the can 2 with thinner walls than those of equivalent containers with a 'petaloid' or 'champagne' base, offering advantages in terms of production cost of the can 2 (less material used) and of the stability thereof when under pressure (greater safety).

In the present text, 'essentially hemispherical conformation or sphere cap' means that most (more than 65%) of the surface has this configuration. Indeed, since the can 2 is made by means of a blowing process, it is possible that a limited part, located in correspondence with the axis of the hemispherical surface coinciding with that of the container, has a different conformation, to meet blowing requirements.

The container 1 optimises transportation of a plurality of identical containers, for example, when palletised. Indeed, a container 1 such as the one described, may be stacked easily and effectively and the presence of a base 10, thus configured, offers valid protection of the stem. Indeed, the stem is a very delicate component and highly prone to breakage precisely because of the protruding nature thereof, especially when the canister is transported pressurised (for example, at 2-3 bar) prior to filling with the substance to be dispensed.

Figure 5:
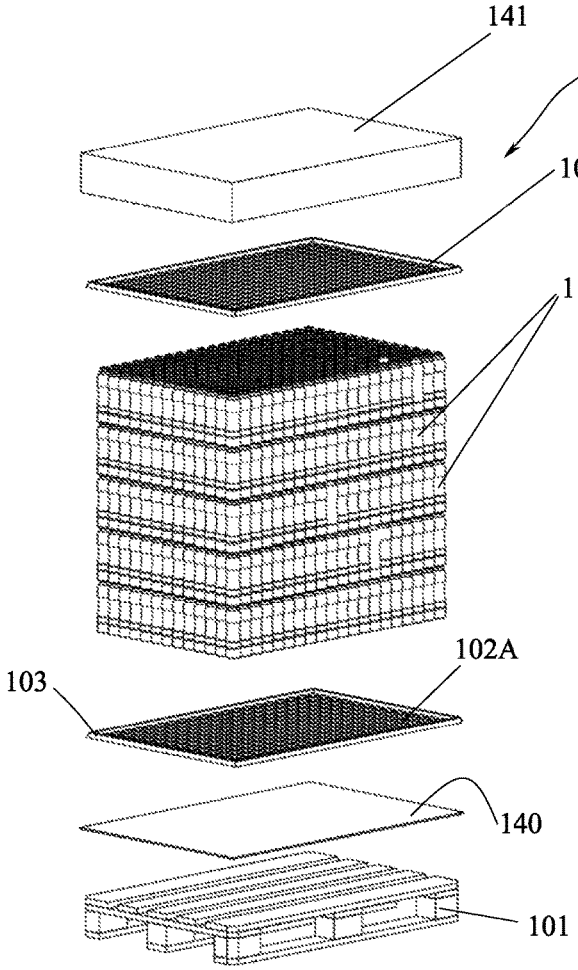
FIG. 5 is an exploded view of a pallet of the containers in FIG. 1.
Figure 6:
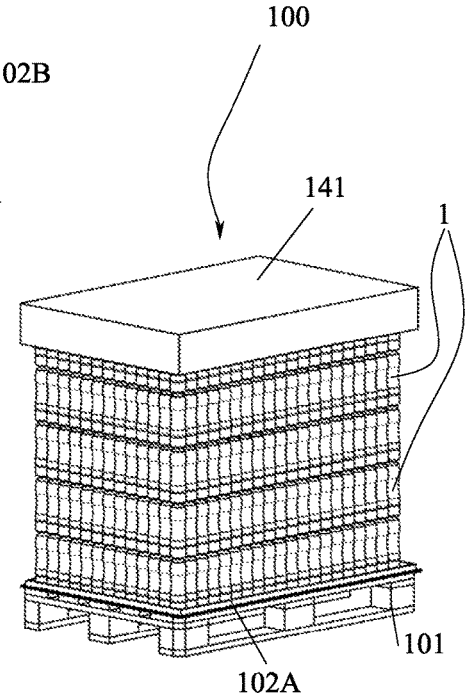
FIG. 6 is a perspective view of a pallet of the containers in FIG. 1.

The container described above, or better a plurality thereof, may be easily transported by means of a transport system such as that shown in FIGS. 5 and 6.

Such system comprises a first thermoformed sheet 102A and a second thermoformed sheet 102B, both of which are identical.

Figure 4:
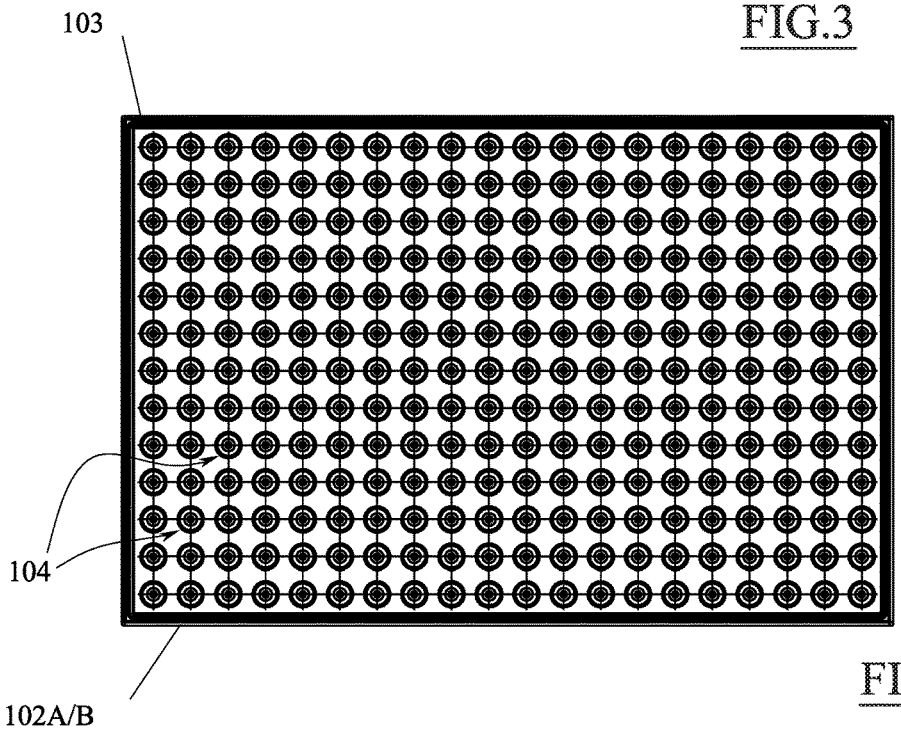
FIG. 4 is a top-down plan view of a thermoformed sheet used for the transportation of several of the containers in FIG. 1 when stacked.
Figure 4A:
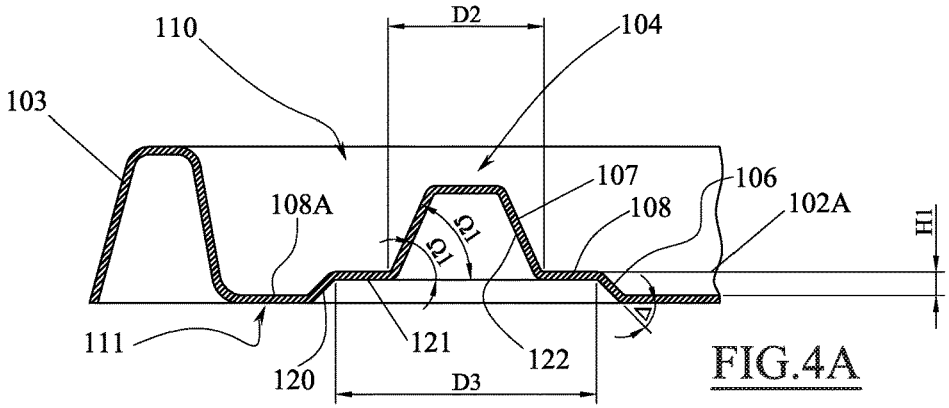
FIG. 4A is a section view of a detail of the thermoformed sheet in FIG. 4.

FIG. 4A shows a plan view of a thermoformed sheet 102A, 102B.

Each thermoformed sheet is shaped to form a plurality of stations 104 to house the columns of stacked containers 1. In the example, the thermoformed sheet 102A in FIG. 4 is designed to be positioned on a pallet 101, for example, a euro-pallet, and may have 260 stations 104.

Each station 104, which is clearly visible in the section view in FIG. 4A, features (on a first face 110) a (convex) raised portion featuring a first 106 and a second centring conical portion 107, and a support portion 108, for the base of the container.

Figure 2:
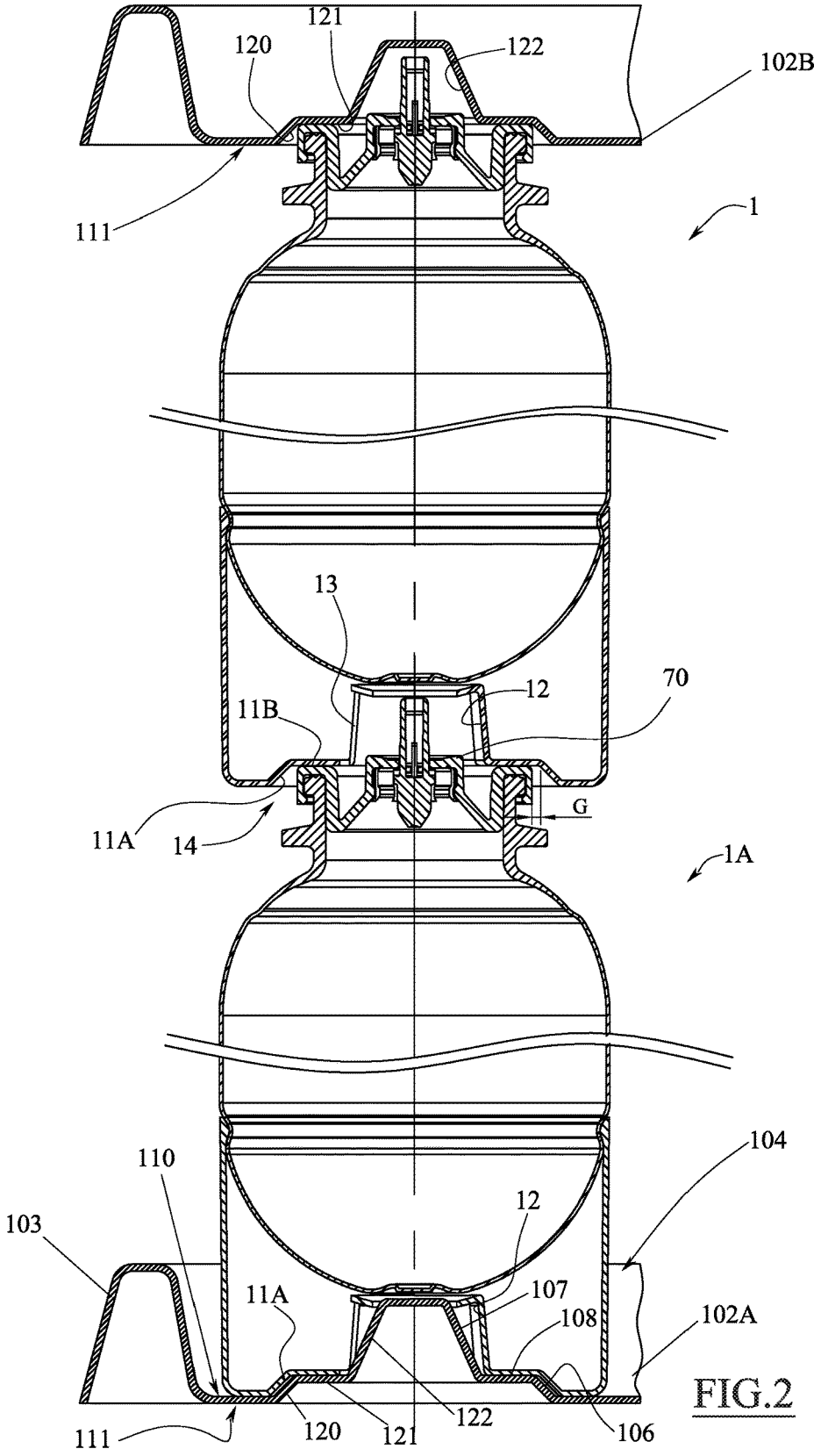
FIG. 2 is a simplified axial section view of a plurality of the containers in FIG. 1 stacked and ready for transportation.

As can be seen in FIG. 2 below and in FIG. 4A, the first conical portion 106 and the second conical portion 107 are configured so as to centre the base 10 of the container, and specifically to centre, with clearance, respectively the first centering surface 11A and the third recessed surface 12 of the base 10 of the container.

Advantageously, therefore, the height H1 and the diameter D2 of the thermoformed sheet are the same as those of the corresponding coupling surfaces of the base 10 (and are, in fact, denoted using the same references).

Nevertheless, to allow easy coupling between the third surface 12 and the second conical portion 107, the latter may have an inclination Q1 with respect to that of the third support portion 108, which is less than Q.

This configuration further helps centring.

The maximum diameter D2 of the second conical portion may correspond to that D2 of the base 10.

Furthermore, each station 104, on a second face 111 facing the first 110, has a recessed (concave) portion defined by a fourth centering portion 120 configured so as to centre the valve cup 6 of a container, a fifth portion 121 for the stable support of at least part of the second thermoformed sheet 102B on the valve cup 6 and a sixth portion 122 which is recessed with respect to the fifth portion 121 and configured to house and protect the stem 7 of an aerosol valve 5 of a container 1A.

Advantageously, the fourth portion 120 has a truncated-cone configuration. Also, the sixth recessed portion 122 may have a truncated cone configuration.

Advantageously, the maximum diameter D3 of the fifth portion is greater than the diameter D1 of the base 10. Continuing the description of the transport system (FIG. 5), it should be noted that the said system comprises a pallet 101 on top of which the first thermoformed sheet 102A is placed.

A plurality of containers 1 (for example 5) is located above the thermoformed sheet 102A, arranged in columns of equal height and each one positioned on a station 104 on the first thermoformed sheet 102A arranged on the pallet 101 with the first face 110 facing the bases of the containers.

The second thermoformed sheet 102B, meanwhile, is placed above the columns of containers 1 with the second face 111 facing the valve elements 5 of the containers, so as to stabilise the columns during handling of the pallet 101 and effectively protect the valve stem.

Advantageously, a first sheet of corrugated cardboard 140 is interposed between the first thermoformed sheet 102A and the pallet 101.

Furthermore, above the second thermoformed sheet 102B, a second sheet of corrugated cardboard carton 141 may be provided, having edges covering at least a part of the containers.

The system shown allows the safe transportation, with minimum overall dimensions, of a plurality of identical containers 1, 1A, as shown in the figures.

Furthermore, the presence of a base/valve cup coupling like the one described guarantees to each column of containers a vertical stability.

This stability is accentuated by the presence of two identical thermoformed sheets, which stabilise the group of columns.

Also, the fact that the thermoformed sheets 102A and 102B are identical minimises any errors in the formation of the pallets.

Furthermore, since the thermoformed sheets are identical, they are perfectly stackable. This also minimises the transportation volume of the thermoformed sheets.

Various embodiments of the innovation have been disclosed herein, but further embodiments may also be conceived using the same innovative concept.

The invention claimed is:

1. Container (1) of a fluid substance, comprising a can (2) having a neck (4) defining an opening (3), a valve element (5) comprising a valve cup (6) supporting a movable hollow stem (7) against an elastic element (8) between a first stable closing position and a second unstable position of fluid delivery through a cavity (7A) of the stem (7), the cavity (7A) of the stem, when the stem is in the dispensing position, being in communication with the interior of the can (2), characterized in that the can (2) is fixed to a support base (10) of the container (1), the base comprising a support surface (14) provided with a recess (11) defined by a first centering surface (11A) configured to center the container (1) on a valve cup (6) of a further identical container on which the container (1) can be piled on, by a second support surface (11B) of stable support of the container (1) on the valve cup (6) and by a third surface (12) recessed with respect to the second surface (11B) configured to house, protecting it, the stem (7) an aerosol valve of the further container (1A).

2. Container (1) according to claim 1, wherein the first surface has a truncated cone shape (1B) and/or wherein the third surface (12) has a truncated cone shape.

3. Container according to claim 1, wherein the third surface (12) comprises windows (13) configured to cooperate with a container rotation tool during soldering of the valve cup to the container.

4. Container according to claim 1, wherein, from the support surface (14) of the base, extends a cylindrical skirt (15) provided at one end of a protruding edge (16) configured to cooperate with a groove (18) of the can for the snap fixing of the base (10) to the can (2).

5. Container according to claim 1, wherein the can has a bottom end (2A) opposite the opening (3) provided with a hemispherical conformation.

6. Container according to claim 1, wherein at least part of a surface of the side of the container and of a lateral base of the base are wound by the same plastic film coating (R), said coating stabilizing the snap coupling between the base and the can.

7. Container according to claim 1, wherein the cavity (7A) of the stem, when the stem is in the dispensing position, is in communication with a deformable bag housed in the can (2) and sealed to the valve element (5).

* * * * *